US008289223B2

(12) United States Patent
Fonseca et al.

(10) Patent No.: US 8,289,223 B2
(45) Date of Patent: Oct. 16, 2012

(54) ANTENNA HAVING OBLIQUE RADIATING ELEMENTS

(75) Inventors: Nelson Fonseca, Cugnaux (FR); Lionel Ries, Toulouse (FR); Sami Hebib, Toulouse (FR); Hervé Aubert, Toulouse (FR); Olivier Pascal, Frouzins (FR)

(73) Assignee: Centre National d'Etudes Spatiales (FR)

( * ) Notice: Subject to any disclaimer, the term of this patent is extended or adjusted under 35 U.S.C. 154(b) by 446 days.

(21) Appl. No.: 12/595,702

(22) PCT Filed: Apr. 14, 2008

(86) PCT No.: PCT/EP2008/054507

§ 371 (c)(1),
(2), (4) Date: Oct. 13, 2009

(87) PCT Pub. No.: WO2008/125662

PCT Pub. Date: Oct. 23, 2008

(65) Prior Publication Data

US 2010/0060543 A1 Mar. 11, 2010

(30) Foreign Application Priority Data

Apr. 13, 2007 (FR) ..... 07 54447

(51) Int. Cl.
*H01Q 1/48* (2006.01)

(52) U.S. Cl. ..... 343/846; 343/700 MS

(58) Field of Classification Search ..... 343/700 MS, 343/853, 846, 848

See application file for complete search history.

(56) References Cited

U.S. PATENT DOCUMENTS

| | | | | |
|---|---|---|---|---|
| 4,878,062 | A | 10/1989 | Craven et al. | |
| 5,065,166 | A | 11/1991 | Kolanski | |
| 5,173,715 | A | 12/1992 | Rodal et al. | |
| 5,521,610 | A | 5/1996 | Rodal | |
| 6,819,291 | B1 | 11/2004 | Lackey et al. | |
| 7,298,333 | B2 * | 11/2007 | Iluz et al. | 343/700 MS |
| 2007/0126637 | A1 * | 6/2007 | Habib et al. | 343/700 MS |

FOREIGN PATENT DOCUMENTS

| | | |
|---|---|---|
| EP | 1223637 A1 | 7/2002 |
| WO | 2005/004283 | 1/2005 |

OTHER PUBLICATIONS

"MF Antennas on High VHF/UHF Masts" Electronics World, Nexus Media Communications, Swanley, Kent, GB, vol. 96, No. 1652, (Jun. 1, 1990), p. 547, XP000 127972.
Search Report from French Application FR 0754447.

* cited by examiner

*Primary Examiner* — Hoanganh Le
(74) *Attorney, Agent, or Firm* — Lerner, David, Littenberg, Krumholz & Mentlik, LLP

(57) ABSTRACT

The invention relates to an antenna comprising a plurality of metallic elements (10, 20, 30, 40), said metallic elements (10, 20, 30, 40) being in point contact (11, 21, 31, 41) with a ground plane (M) and equally distributed about a central axis of symmetry (D) of the antenna, perpendicular to the ground plane (M). The antenna of the invention is characterized in that each metallic element extends from the point contact at a non-zero angle of inclination (q) to said ground plane (M) and in that the ground plane (M) includes at least one cavity (80-83, 84-87) so that, in operation, the antenna matching is better in a specified frequency band than when the ground plane (M) has no cavities.

21 Claims, 5 Drawing Sheets

ANTENNA HAVING OBLIQUE RADIATING ELEMENTS

CROSS REFERENCE TO RELATED APPLICATIONS

The present application is a national phase entry under 35 U.S.C. §371 of International Application No. PCT/EP2008/054507, filed 14 Apr. 2008, which claims the benefit of French Patent Application No. 0754447, filed 13 Apr. 2007. The disclosures of the above applications are incorporated by reference herein.

GENERAL TECHNICAL FIELD

The present invention relates to multiband antennae with circular or linear polarisation and having frequency flexibility.

The invention has particular application in satellite positioning systems such as GPS and Galileo, as well as in satellite broadcast systems for multimedia content.

PRIOR ART

Multiband antennae are used for example in satellite or diffusion positioning systems to reduce the number of onboard or ground-positioned antennae.

In fact, such antennae combine several frequency bands into one and the same antenna. They also enable the combining of several applications.

Multiband antennae are known, comprising four radiating elements out in the form of an inverse L, arranged on a support with slight dielectric constant.

Such an antenna is described for example in the document WO 2005/004283.

However, the structure of current antennae is limited by the form of the radiating elements and their arrangement relative to one another, limiting the reduction in bulk, especially when the aim is to increase flexibility in terms of operating frequencies.

The multiplicity of applications and associated bands reveals the need for multiband antennae having a structure with flexible character, low cost and offering excellent performances or at least equivalent to antennae dedicated to one application or to any given frequency band, at the same time conserving bulk similar or even less.

PRESENTATION OF THE INVENTION

To eliminate the abovementioned problems, the invention proposes an antenna comprising a plurality of metallic elements, said metallic elements being in point contact with a ground plane and distributed uniformly about a central axis of symmetry of the antenna, perpendicular to the ground plane.

The antenna of the invention is characterised in that each metallic element extends from the point contact according to a non-zero angle of inclination relative to said ground plane and in that the ground plane comprises at least one cavity such that when in operation the adaptation of the antenna is better in a specified frequency band than when the ground plane is full.

The antenna of the invention integrates advantageously in satellite-positioning systems and/or in satellite-diffusion systems for multimedia content.

PRESENTATION OF FIGURES

Other characteristics and advantages of the invention will emerge from the following description which is purely illustrative and non-limiting and must be considered in reference to the attached diagrams, in which.

Figure 2:
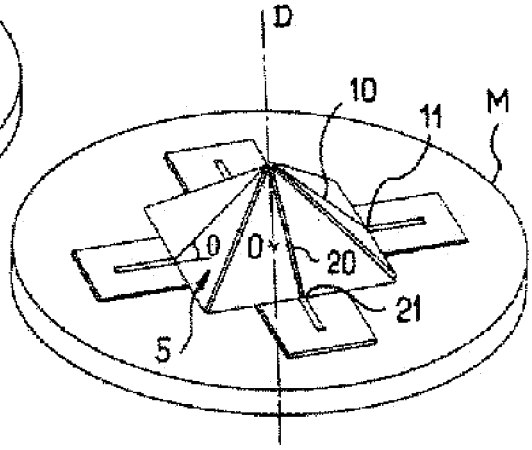
FIG. 2, illustrates the antenna of the invention where the metal strands are arranged on the faces of a substrate.
Figure 3A:
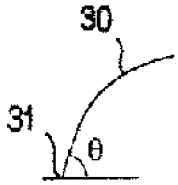
Figure 3B:
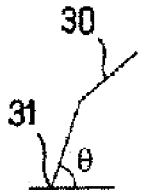
Figure 4A:
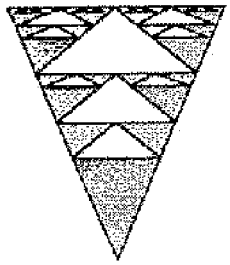
Figure 4B:
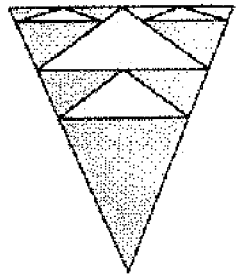
Figure 5:
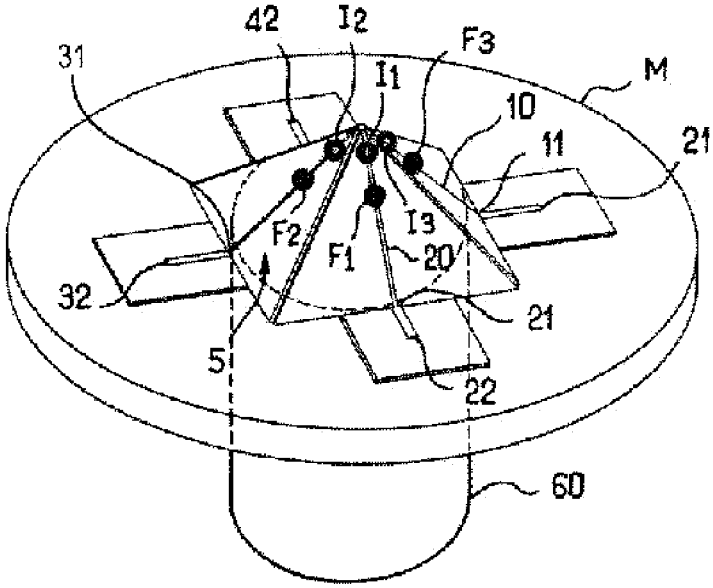
Figure 6A:
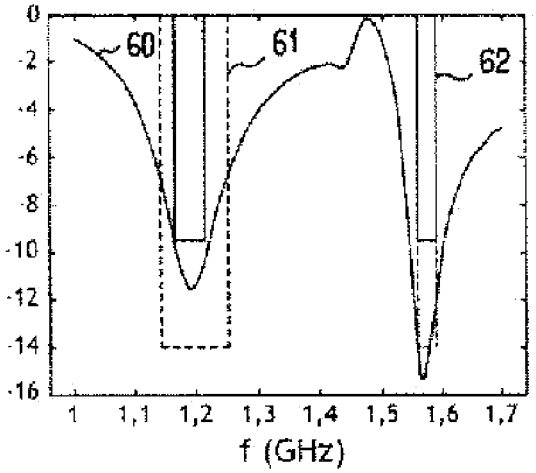
Figure 6B:
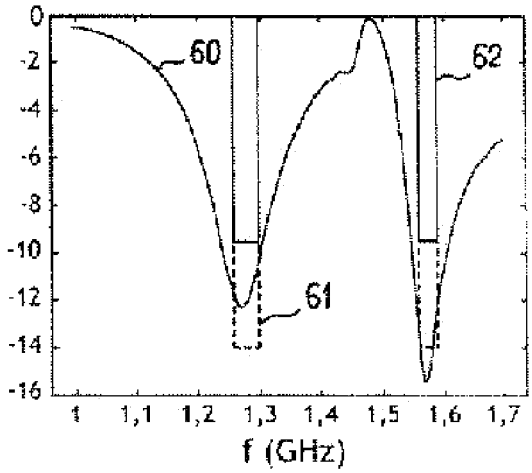
Figure 7A:
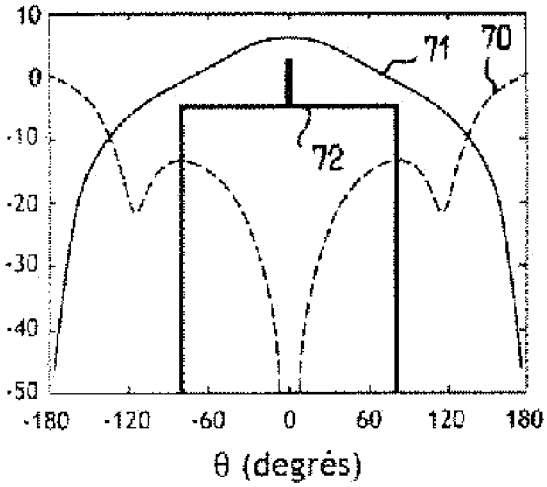
Figure 7B:
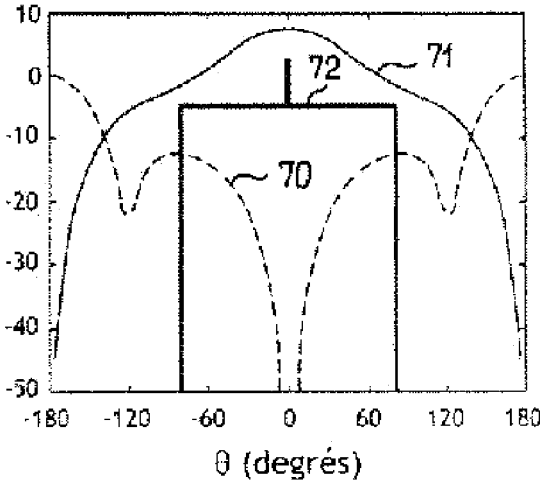
Figure 7C:
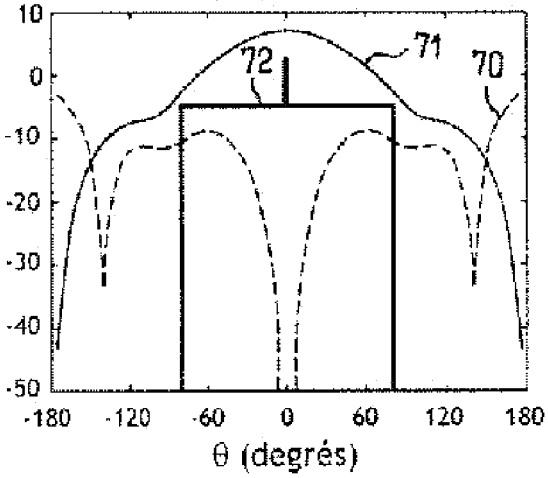
Figure 8A:
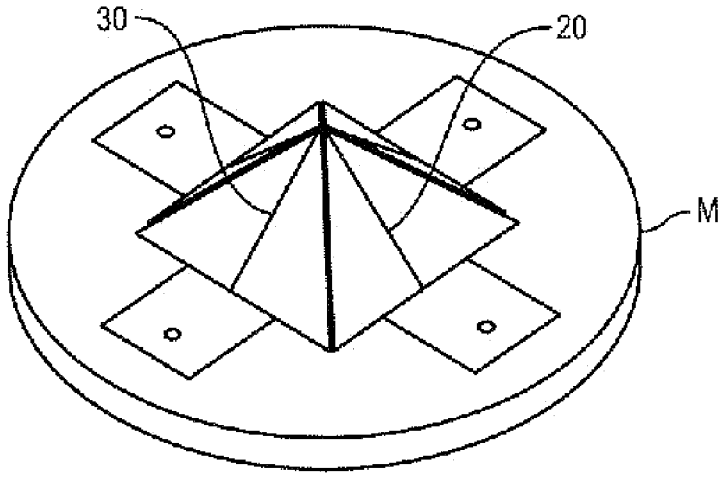
Figure 8B:
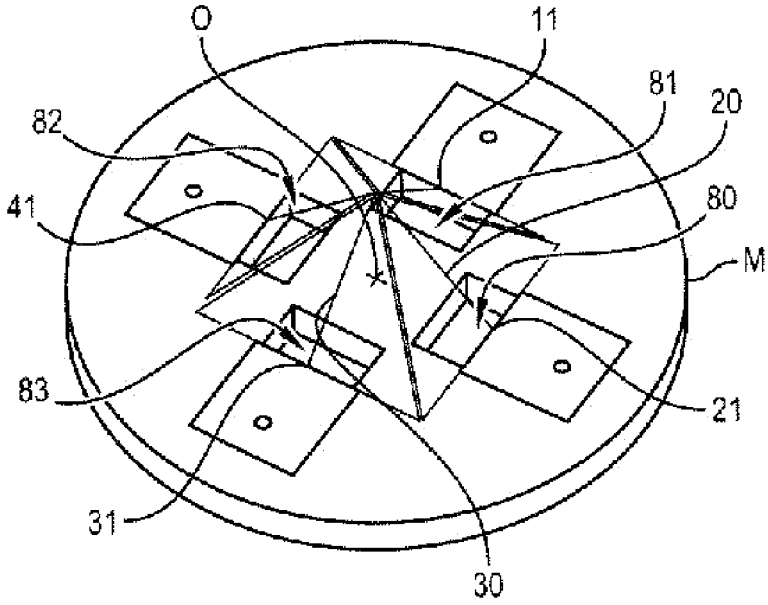
Figure 8C:
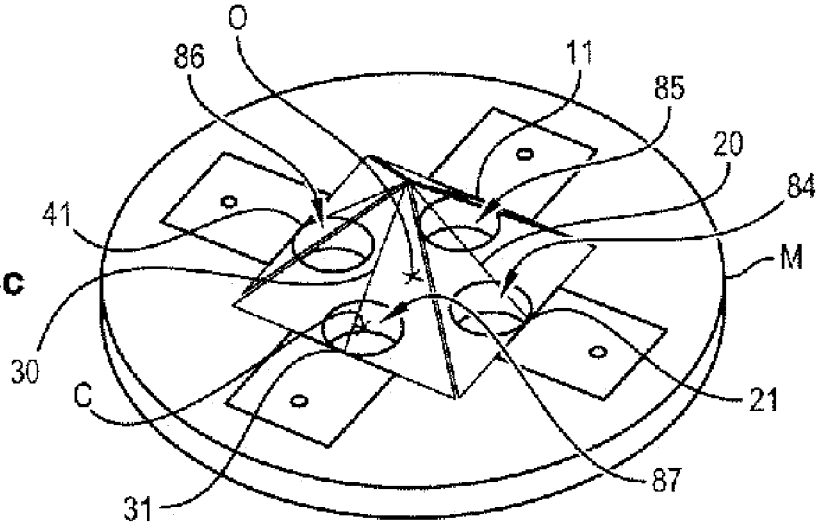
Figure 9A:
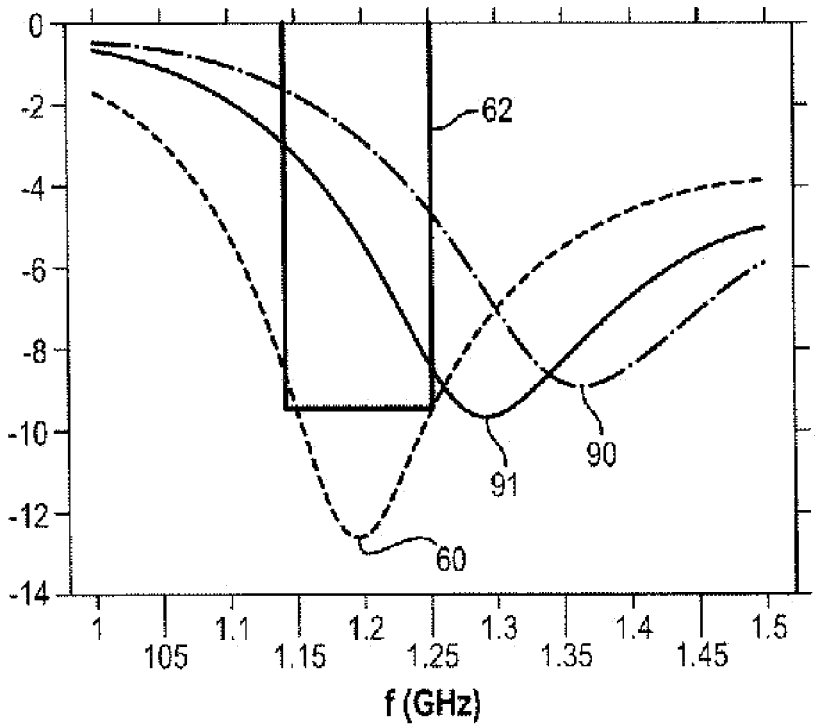
Figure 9B:
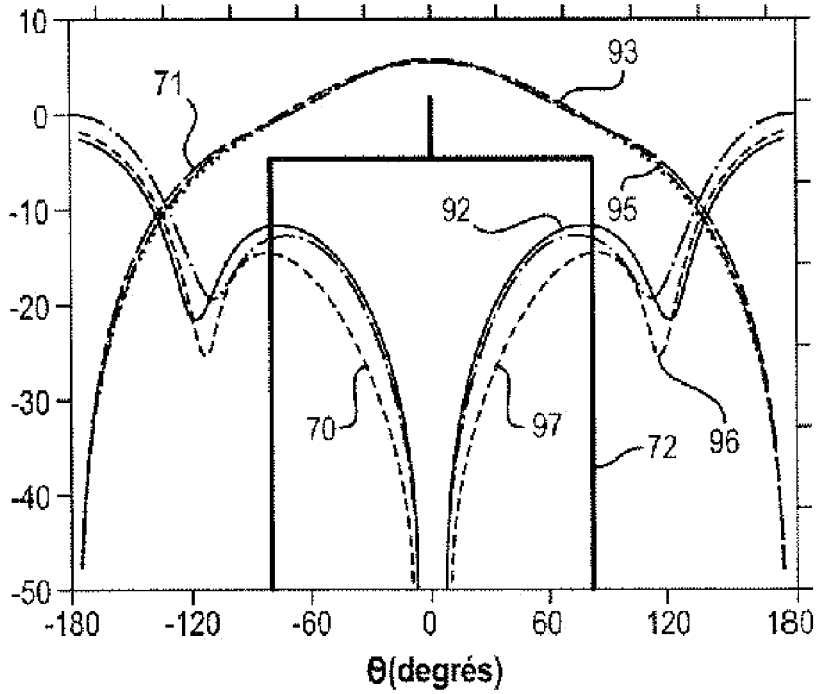

FIGS. 3*a* and 3*b* illustrate the side elevations of two possible geometries other than rectilinear for the metallic elements of the antenna of the invention;

FIGS. 4*a* and 4*b* illustrate possible patterns for the metallic elements of the antenna of the invention, FIG. 5 illustrates the antenna of FIG. 2 with the ground plane prolonged by a cylinder and filters and interrupters arranged on the metallic elements;

FIGS. 6*a* and 6*b* illustrate respectively the reflection coefficient (dB) as a function of the frequency (GHz) of the antenna of FIG. 5 simulated when the interrupters placed on each metallic element are respectively open and closed;

FIGS. 7*a*, 7*b* and 7*c* illustrate the radiation diagram of the antenna of FIG. 5 simulated in the frequencies 1.189 GHz, 1.280 GHz and 1.575 GHz respectively;

FIGS. 8*a*, 8*b*, 8*c* and 8*d* illustrate respectively a full ground plane, a ground plane with four cavities of rectangular form, a ground plane with four cavities of circular form and a ground plane with four cavities of octagonal form;

FIGS. 9*a* and 9*b* illustrate respectively the reflection coefficient (dB) as a function of the frequency for the antenna of FIG. 5, an antenna with a full ground plane (FIG. 8*a*) and an antenna with a ground plane comprising four cavities of circular form (FIG. 8*c*).

DESCRIPTION OF ONE OR MORE EMBODIMENTS AND METHOD

Structure of the Antenna

Figure 1:
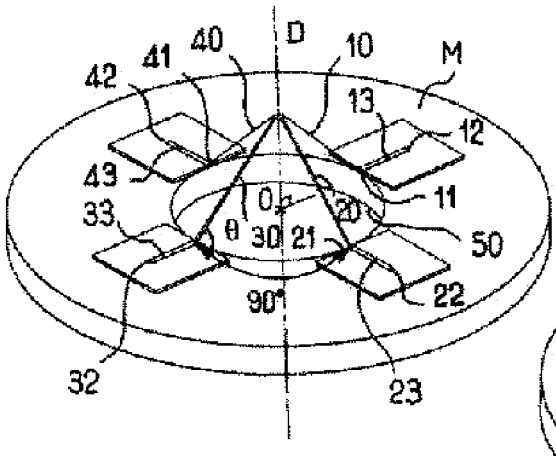
FIG. 1 illustrates the antenna of the invention where the metallic elements are metal strands.

FIG. 1 illustrates an antenna comprising metallic elements which, in operation, are capable of radiating consequently forming radiating elements.

The structure of the antenna generally comprises a plurality of metallic elements, 10, 20, 30, 40.

The antenna typically comprises four metallic elements. The metallic elements 10, 20, 30, 40 are distributed about a central axis of symmetry D of the antenna, perpendicular to the ground plane M (it is understood here that the axis of symmetry passes through the centre O of the ground plane M).

The metallic elements are in point contact 11, 21, 31, 41 with the ground plane M. They extend also from the ground plane M according to a non-zero angle of inclination θ relative to the ground plane M.

The angle of inclination θ of the metallic elements with the ground plane M is a function of the application. It can be consequently right, acute (less than)90° or obtuse (greater than)90°.

Advantageously, the metallic elements are distributed uniformly about a circle of centre, the centre O of the ground plane M.

Such a case is illustrated in FIG. 1, in which the antenna comprises four metallic elements and 90° separating the part 11, 21, 31, 41 from each metallic element in point contact with the ground plane M.

By way of advantage, the metallic elements, 10, 20, 30, 40, are identical and their angle of inclination θ relative to the ground plane M is equal to 45°. Also, the angle of inclination θ initiated at each metallic element is such that the metallic elements are oriented in the same direction, and they can be oriented in the direction of the axis of symmetry D of the antenna or else in an opposite direction.

On the antenna of FIG. 1, the metallic elements are oriented in the direction of the axis of symmetry D of the antenna perpendicular to the ground plane M.

It should be noted that the metallic elements 10, 20, 30, 40 are imprinted on a dielectric substrate, this substrate also being supported by a pyramid structure S not having radio frequency properties. The pyramid structure can also comprise a number of sides greater than four.

Such a structure ensures the mechanical behaviour of the antenna and can be made of polystyrene.

FIG. 2 illustrates an antenna comprising a pyramid structure S on which are arranged the metallic elements imprinted on a dielectric substrate. The structure is of a form adapted to the inclination of the metallic elements 10, 20, 30, 40.

In FIG. 2, the structure S has a pyramid form. A structure S of this form will preferably be used for making the antenna. The metallic elements are arranged on each of the faces of the structure S.

Metallic Elements

The metallic elements can take different forms.

FIGS. 3*a*, 3*b* illustrate respectively a metallic element in the form of a strand in an arc of a circle and a metallic element in the form of a broken strand.

More complex geometrical patterns can be envisaged, apart from strands.

FIGS. 4*a* and 4*b* illustrate patterns with fractal geometry obtained after several iterations of a triangular form.

The form, the pattern, the length and the inclination of the metallic elements are parameters which influence the bandwidth and the radiation diagram of the antenna.

Ground Plane

The ground plane M has dimensions which will condition the performance of the antenna in terms of radiation.

The ground plane M is typically circular. The thickness and the radius of the ground plane M are dimensioned so as to limit the reflections on its edges. Also, the ground plane M can comprise a cavity 50 arranged at its centre for improving the adaptation of the antenna, as is illustrated in FIG. 1. The cavity is circular, square or octagonal.

In addition, in this configuration, in order to limit the rear radiation engendered by the cavity arranged in the ground plane, it can be extended by a cylinder, a pyramid or a cone, the latter two forms able to be truncated, if needed. FIG. 5 illustrates an antenna comprising a cylinder 60 or right waveguide, prolonging the ground plane. The dimensions of the cylinder are adapted to the cavity 50.

Such a cylinder acts as a waveguide functioning under its cut-off frequency which limits the rear radiation of the antenna.

As already mentioned, the ground plane M can be prolonged by a pyramid (pyramid waveguide) or a cone (waveguide conical), this form being truncated if needed as a function of the restrictions of bulk and performance in rear radiation.

The use of these forms closes the ground plane M, and thus reduces the rear radiation while retaining the improvement of the adaptation of the antenna associated with the cavity.

The extension of the ground plane M by a cone, a pyramid or a cylinder contributes to performance improvement of the antenna and also constitutes additional adjustment means of the antenna.

So as to be correctly positioned at the level of the ground plane M, the form of the section of the guide (right, pyramid or conical) is identical to the cavity arranged in the ground plane M. As a function of the targeted application, it is possible not to utilise a form prolonging the ground plane M in order to reduce the bulk of the antenna.

In this case, the ground plane M can comprise several cavities. Such a configuration controls the rear radiation while having better adaptation than in the case where the ground plane M is full (FIG. 8*a* illustrates an antenna with a full ground plane M).

The ground plane M must comprise a number of cavities equal to the number of metallic elements, that is, four cavities.

FIGS. 8*b* and 8*c* illustrate a ground plane M comprising four cavities 80-83, 84-87. In FIG. 8*b* the cavities 80-83 are rectangular. The rectangular form is such that the point contact of each metallic element with the ground plane M defines the middle of one of the sides of each upper part of the rectangular form. In FIG. 8*c* the cavities 84-87 are circular, each adjacent to a point contact. In addition, for each cavity, the tangent T to the upper part of the circular cavity passes through the corresponding point contact.

In the configuration with several cavities, the latter are distributed uniformly in the same way as the metallic elements (the radiating elements of the antenna).

Rotation of 90° is generally necessary for moving from one cavity to another.

The cavities of rectangular form are provided inside a square of centre O, the centre of the ground plane M, the distance of the centre O from the point contacts defining the perpendicular bisectors of the square.

The cavities of circular form are as such provided inside the circle provided au square mentioned hereinabove.

Figure 8D:
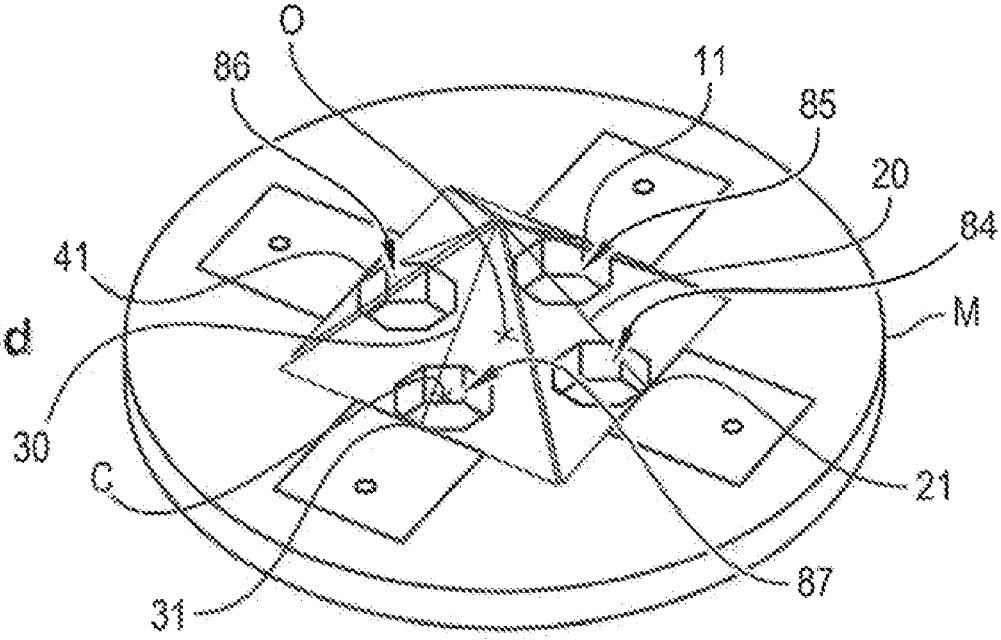

The cavities can also be rectangular or octagonal (see FIG. 8*d*).

Also, the four cavities of the ground plane M can be prolonged by right, pyramid or conical, optionally truncated waveguides. These waveguides are arranged at the level of the cavities and are such that the form of their cross-sections at the level of the contact with the ground plane M is identical to the cavities arranged in the latter.

Antenna Feed

The antenna is fed by means of excitations 12, 22, 32, 42 located at the level of the contact 11, 21, 31, of each metallic element 10, 20, 30, 40 with the ground plane M.

For production purposes, transmission lines 13, 23, 33, 43 are preferably used in the extension of each metallic element. The excitation points are connected to the ends of these transmission lines underneath the ground plane M to be made there consequently.

Use of these transmission lines and their dimensioning is a function of the cavity made in the ground plane M.

The transmission lines are for example microribbon lines of characteristic impedance equal to 50 [Omega] formed in the same material as the substrate S on which the metallic elements are imprinted.

The antenna presented is a circular or linear polarisation antenna. Linear polarisation occurs when two metallic elements are supplied; in this case they are supplied with voltages of identical amplitudes in phase opposition.

Circular polarisation occurs as such when four metallic elements are supplied; in this case they are supplied with voltages of identical amplitudes in phase quadrature.

Flexible and/or Multiband Character of the Antenna

The antenna also has a flexible and/or multiband character.

As is known per se it is the geometry of the radiating elements which conditions the operating frequencies of an antenna. The multiband aspect is obtained by means of "band-elimination" filters F1, F2, F3, F4 (not shown), typically constituted by a circuit comprising inductance L and a condenser C mounted in parallel. These filters are placed on each of the metallic elements.

The flexible character in terms of operating frequency of the antenna is obtained by means of interrupters, 11, 12, 13, 14 (not shown) mounted on each of the metallic elements.

In practice, according to their position "open" or "closed" the interrupters regulate the length and/or geometry of the metallic elements. More precisely, in terms of performance, they displace the operating frequencies of the antenna to lower frequencies especially when they are switched to the closed position. It is significant that on each of the metallic elements the filters and the interrupters are positioned identically on each of the metallic elements to retain the symmetry of the radiating structure.

Prototype

To validate the abovementioned antenna structure, several prototypes have been made and tested to verify whether they satisfy the adaptation and radiation restrictions in the preferred operating frequency band. The resulting prototypes comprise four radiating elements.

The resulting prototype is that illustrated by FIG. 5 in particular.

In this figure, the antenna comprises four metal strands radiating de width equal to 1 mm imprinted on a dielectric substrate arranged on a support made of polystyrene in the form of a pyramid. The dielectric substrate in this case has dielectric permittivity equal to 2.08 and thickness typically equal to 0.762 mm.

The metallic elements are prolonged by microribbon lines of width equal to 2.39 mm to which the excitations associated with each metallic element are to be connected. As already discussed, according to the feed the antenna has linear or circular polarisation.

Linear polarisation occurs by feeding two opposite metallic elements.

Circular polarisation occurs by feeding the four metallic elements.

Frequency flexibility occurs by means of interrupters arranged along the metallic elements.

The multiband aspect is obtained by means of band-elimination filters arranged along the metallic elements. The prototype produced here is bi-band and embodies the following three bands (bi-band at any given instant and possibility of switching by means of interrupters to reach the third band). The bands are the following: band 1: E5a/L5 and E5b, band 2: E6, band 3: L1 extended.

The band 3 is still present and according to the open or closed position of the interrupters, this allows the band 1 and the band 3 or the band 2 and the band 3.

The frequencies of the bands focussed on by the antenna are, by way of non-limiting illustration, those of the GPS system (in English, "Global Positioning System") and of the Galileo system.

The frequencies of the system GPS are the following. Band L1: 1,563-1,587 GHZ (civil applications), band L2: 1,215-1,237 GHz (mainly military applications), band L5: 1,164-1,197 GHz (in light of the modernisation of the current GPS system).

The frequencies of the Galileo system are the following.

Band E5a: 1,164-1,197 GHz, band E5b: 1,197-1,214 GHz, band E5 extended: 1,142-1,252 GHz (for applications requiring high precision), band E6: 1,260-1,300 GHz, band L1 extended (cf. system GPS): 1,559-1,591 GHz.

FIGS. 6*a* and 6*b* illustrate the reflection coefficient (dB) as a function of the operating frequency (GHz) when the interrupters are in the open position (cf. FIG. 6*a*) and in the closed position (cf. FIG. 6*b*). Such a parameter tests the performances of the antenna in adaptation.

In these figures, the curve 60 is obtained by simulations made on the prototype, the curve 61 is the target curve to be achieved and the curve 62 corresponds to the nominal adaptation specifications in the preferred bands.

It should be noted in these figures that the antenna is bi-band by the use of filters.

In fact, as provided the band 3 (L1 extended) is still present. The bands 1 and 2 are respectively attained according to the open or closed position of the interrupters. Still in reference to FIGS. 6*a* and 6*b* it is noted that the adaptation for each of the preferred bands satisfies the required nominal specifications.

Such adaptation enables emission of close to 90% of the energy transmitted to the antenna.

Also, as a function of the state of the interrupter the retained bands indifferently utilise this same antenna for civil security applications (aviation, etc.) or commercial satellite navigation services. The choice between flexibility and multiband is guided by the application and above all the proximity of the frequency bands to be covered. The nature of the filters employed imposes minimum separation between two successive frequency bands.

When the latter are relatively near, it is preferable to opt for an interrupter if the performances of the radiating elements are such that they do not simultaneously cover the two frequency bands in question. This latter point can guide the choice of the pattern of the radiating elements.

FIGS. 7*a*, 7*b* and 7*c* illustrate the radiation diagram of the antenna of FIG. 5 simulated in the frequencies 1.189 GHz, 1.280 GHz and 1.575 GHz respectively.

The antenna presented has circular polarisation, and the radiating elements are fed in phase quadrature.

In these figures the curve 70 is the radiation diagram in left circular polarisation, the curve 71 is the radiation diagram in right circular polarisation and the curve 72 is a template representing the minimal values required in principal polarisation.

It is evident in FIGS. 7*a*, 7*b* and 7*c* that the resulting radiation diagrams are quasi hemispheric in nature, permitting reception of a maximum number of signals from visible satellites.

This type of radiation diagram is characteristic of receptor antennae for satellite navigation applications. Cross polarisation obtained in simulation is less than −10 dB in the demi-space of interest, ensuring purity of polarisation necessary for proper functioning of the antenna.

FIGS. 9*a* and 9*b* illustrate performances compared to an antenna with a ground plane comprising a cavity arranged at its centre prolonged by a cylinder, an antenna with a full ground plane, an antenna with a ground plane comprising four cavities.

The latter two solutions can be envisaged to offer reduced bulk in the height of the antenna if the application requires this.

FIG. 9*a* illustrates the reflection coefficient (dB) as a function of the operating frequency (GHz).

In this figure, the curves 60, 90 and 91 illustrate the reflection coefficient for respectively the antenna with a ground plane comprising a cavity arranged at its centre prolonged by a cylinder, for the antenna with a ground plane comprising four cavities, for the antenna with a full ground plane and the curve 62 represents the expected specifications.

It emerges from this figure that the antenna with a ground plane comprising four cavities, curve 91 is an intermediate solution between a solution with a full ground plane, curve 90 and the best solution, specifically an antenna with a ground plane comprising a cavity arranged at its centre.

For the same length of radiating elements, the different embodiments of the ground plane offer frequencies of different resonance.

Therefore, the radiating elements have been optimised in adaptation for the ground plane comprising a cavity arranged at its centre and prolonged by a cylinder, curve 60. The same radiating elements arranged on a full ground plane exhibit upward frequency offset of around 14%, curve 90, which presupposes that correction of this offset in frequency requires lengthening of the radiating elements of the same order.

The same radiating elements arranged on a ground plane comprising four cavities exhibit upward frequency offset of 8%, curve 91, which presupposes lengthening of the less significant radiating elements by close to half, compared to the solution with a full ground plane.

In addition, FIG. 9*b* illustrates the radiation diagram (dBi) as a function of the angle e (degrees). In this figure, the curves 93, 94 and 71 represent left circular polarisation for respectively the antenna with a ground plane comprising a cavity arranged at its centre prolonged by a cylinder, for the antenna with a ground plane comprising four cavities, for the antenna with a full ground plane. Still in this figure, the curves 97, 96 and 70 represent cross polarisation for respectively the antenna with a ground plane comprising a cavity arranged at its centre prolonged by a cylinder, for the antenna with a ground plane comprising four cavities, for the antenna with a full ground plane and the curve 72 represents the expected specifications for principal polarisation.

In terms of left circular polarisation, the performances of the antennae are equivalent.

In terms of cross polarisation the performances of the antenna with a ground plane comprising a cavity at the centre prolonged by a cylinder are the best in the demi-space of interest (θ of between −90° and +90°). On the contrary, this solution has rear radiation (θ close to +−180° greater than the solutions with full ground plane or four cavities.

This latter parameter can prove important if the preferred application requires reducing of the electromagnetic interactions with the carrier structure. The performances of the antenna with a full ground plane are similar to the performances with a ground plane comprising four cavities, at the same time in the semi-space of interest and in rear radiation. The antenna with a ground plane comprising four cavities thus avoids using a cylinder to improve the level of the rear radiation. This also allows a gain in the total height of the antenna while retaining acceptable performances in terms of adaptation and cross polarisation. Of course, if the preferred application allows it, the antenna with a ground plane comprising a cavity at its centre prolonged by a cylinder since it has better adaptation will preferably be used.

By its structure the antenna described has numerous possibilities as to different possible adjustments (inclination, geometry of the metallic elements and of the ground plane, filters and/or interrupters on the metallic elements) of the antenna contributing to a multiplicity of preferred applications.

In addition, the different degrees of liberty as to the inclination and geometry of the metallic elements optimise the bulk of such an antenna and adapt the radiation diagram of the antenna to the preferred applications.

The invention claimed is:

1. An antenna comprising:

a plurality of metallic elements, said metallic elements being in point contact with a ground plane and distributed uniformly about an axis of central symmetry of the antenna, perpendicular to the ground plane, wherein each metallic element extends from the point contact according to a non-zero angle of inclination (θ) relative to said ground plane and wherein the ground plane comprises four cavities such that in operation the adaptation of the antenna is better in a specified frequency band than when the ground plane is full.

2. An antenna as claimed in claim 1, wherein the cavities are each adjacent to a point contact and whereof the form is circular, square, rectangular, or octagonal.

3. An antenna as claimed in claim 1, wherein the four cavities of the ground plane are prolonged by waveguides right, pyramid or conical arranged at the level of the cavities arranged in the ground plane and such that the form of their sections at the point contact with the ground plane is identical to the cavities arranged in the latter.

4. An antenna as claimed in claim 3, wherein the waveguides are truncated.

5. An antenna as claimed in claim 1, wherein the cavities are distributed uniformly over the ground plane.

6. An antenna as claimed in claim 1, wherein the metallic elements are identical.

7. An antenna as claimed in claim 1, wherein the metallic elements are metal strands.

8. An antenna as claimed in claim 1, wherein the metallic elements are broken metal strands.

9. An antenna as claimed in claim 1, wherein the metallic elements are triangular.

10. An antenna as claimed claim 1, wherein the metallic elements form a pyramid structure.

11. An antenna as claimed in claim 1, wherein the metallic elements are arcs of a circle.

12. An antenna as claimed in claim 1, wherein the metallic elements are oriented in the direction of the axis of symmetry of the antenna around which they are distributed.

13. An antenna as claimed in claim 1, wherein the angle of inclination (θ) of the metallic elements relative to the ground plane is equal to 45°.

14. An antenna as claimed in claim 1, wherein the metallic elements are fed at the level of the point contacts with the ground plane.

15. An antenna as claimed claim 1, wherein the metallic elements are supported by a pyramid structure having no radio frequency properties.

16. An antenna as claimed in claim 1, wherein the ground plane is circular.

17. An antenna as claimed in claim 1, further comprising filters arranged on each metallic element.

18. An antenna as claimed in claim 1, further comprising interrupters arranged on each metallic element.

19. Use of an antenna as claimed in claim 1 in a satellite-positioning system.

20. Use of an antenna as claimed in claim 1 in a satellite diffusion system for multimedia content.

21. Use of an antenna as claimed in claim 1 in a system including a satellite-positioning system and a satellite diffusion system for multimedia content.

* * * * *